US011143988B2

(12) United States Patent
Miyake et al.

(10) Patent No.: US 11,143,988 B2
(45) Date of Patent: Oct. 12, 2021

(54) BELT DRIVING DEVICE WITH STEERING ROLLER

(71) Applicant: HEWLETT-PACKARD DEVELOPMENT COMPANY, L.P., Spring, TX (US)

(72) Inventors: Koji Miyake, Yokohama (JP); Satoru Hori, Yokohama (JP); Yuji Aoshima, Yokohama (JP); Kensuke Nakajima, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/755,382

(22) PCT Filed: Oct. 12, 2018

(86) PCT No.: PCT/KR2018/012000
§ 371 (c)(1),
(2) Date: Apr. 10, 2020

(87) PCT Pub. No.: WO2019/083202
PCT Pub. Date: May 2, 2019

(65) Prior Publication Data

US 2021/0208524 A1 Jul. 8, 2021

(30) Foreign Application Priority Data

Oct. 27, 2017 (JP) ..... JP2017-208336

(51) Int. Cl.
*G03G 15/01* (2006.01)
*G03G 15/16* (2006.01)

(52) U.S. Cl.
CPC ..... *G03G 15/1615* (2013.01); *G03G 2215/00139* (2013.01)

(58) Field of Classification Search
CPC ..... G03G 15/1615; G03G 2215/00143; G03G 2215/00151
USPC ..... 399/302
See application file for complete search history.

(56) References Cited

U.S. PATENT DOCUMENTS

| | | | | |
|---|---|---|---|---|
| 10,322,893 | B2 * | 6/2019 | Nakajima | G03G 15/1615 |
| 10,365,590 | B2 * | 7/2019 | Kudo | G03G 15/1615 |
| 2012/0082489 | A1 | 4/2012 | Shirakata | |
| 2013/0209145 | A1 | 8/2013 | Hasegawa | |
| 2020/0299083 | A1 * | 9/2020 | Miyake et al. | B65H 5/021 |

FOREIGN PATENT DOCUMENTS

| | | |
|---|---|---|
| JP | 2008-268954 | 11/2008 |
| JP | 2013-164507 | 8/2013 |
| JP | 2014-106482 | 6/2014 |
| JP | 2016-175729 | 10/2016 |

* cited by examiner

*Primary Examiner* — William J Royer
(74) *Attorney, Agent, or Firm* — Staas & Halsey LLP

(57) ABSTRACT

A belt driving device to drive an endless belt, includes a drive roller and a suspension roller which extend in a first direction and face each other in a second direction. The belt driving device includes a steering roller located between the drive roller and the suspension roller in a tiltable manner. A pulley (or wheel) is located at an end portion of the steering roller. The belt driving device includes a link mechanism which presses the end portion of the steering roller to tilt the steering roller with the movement of the pulley (or wheel).

17 Claims, 9 Drawing Sheets

BELT DRIVING DEVICE WITH STEERING ROLLER

CROSS REFERENCE TO RELATED APPLICATIONS

This application is a U.S. National Stage Application which claims the benefit under 35 U.S.C. § 371 of International Patent Application No. PCT/KR2018/012000 filed on Oct. 12, 2018, which claims foreign priority benefit under 35 U.S.C. § 119 of Japanese Patent Application No, 2017-208336 filed on Oct. 27, 2017, in the Japanese Intellectual Property Office, the contents of all of which are incorporated herein by reference.

BACKGROUND ART

In an image forming apparatus, for example, an endless belt is used as a conveyor belt for conveying a sheet or an intermediate transfer belt for secondarily transferring a toner. The endless belt is wound around a drive roller and a suspension roller (driven roller) and is driven along a circumferential orbit when power generated by the drive roller is transmitted thereto.

In some existing techniques, when the endless belt moves in the width direction, ribs provided on an inner circumferential surface (rear surface) of the endless belt contact a detection roller so that the detection roller rotates. A steering roller is tilted by the transmission of the rotation of the detection roller to correct a rotation direction of the endless belt. The ribs are provided at the end portion of the endless belt in the width direction and are formed to protrude inward in the radial direction of the drive roller.

MODE FOR INVENTION

Figure 1:
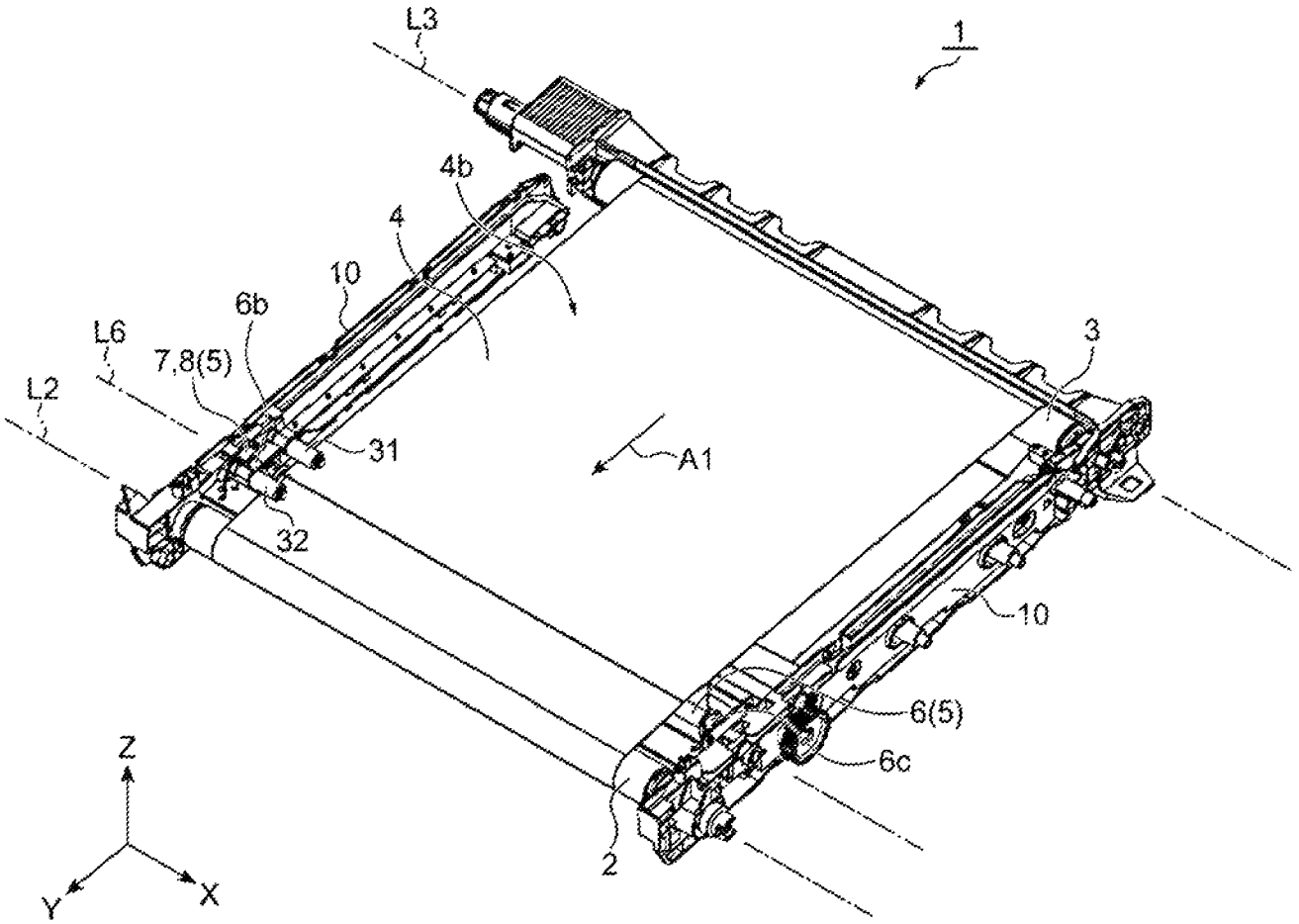
FIG. 1 is a perspective view illustrating an example belt driving device.

In the following description, with reference to the drawings, the same reference numbers are assigned to the same components or to similar components having the same function, and overlapping description is omitted.

In existing techniques providing ribs inside an endless belt, when the ribs are depleted, the endless belt may move onto the detection roller even when the endless belt moves in the width direction and thus the movement of the endless belt in the width direction may go undetected. Further, when an endless belt without any ribs is used in combination with the detection roller, a movement of the endless belt in the width direction cannot be detected by the detection roller.

An example belt driving device includes a drive roller which drives an endless belt and a suspension roller which rotates in a following manner with the movement (e.g. a rotational movement) of the endless belt while the endless belt is wound thereon. The drive roller and the suspension roller extend in a first direction and are disposed to face each other in a second direction intersecting the first direction. The belt driving device includes a steering roller which is disposed between the drive roller and the suspension roller. The steering roller rotates in a following manner with the movement of the endless belt. The steering roller is tiltable while one end portion of the steering roller in the longitudinal direction moves in a third direction intersecting the first direction and the second direction.

The example belt driving device includes a pulley (or wheel). The pulley (or wheel) is inserted through an end portion of the steering roller. The pulley (or wheel) protrudes in a radial direction of the steering roller and is able to come into contact with an end surface of one end portion of the endless belt in a width direction. The end portion of the endless belt may also be referred to herein as an edge portion of the endless belt or as a side portion of the endless belt. The pulley (or wheel) is pressed with the movement (e.g. a shifting movement) of the endless belt in the first direction to move in an axis line direction (e.g. a rotational axis) of the steering roller. The belt driving device includes a link mechanism. The link mechanism includes a curved surface which comes into contact with the pulley (or wheel) in the first direction. The link mechanism tilts the steering roller by moving the end portion of the steering roller inward in the third direction, with the outward movement of the pulley (or wheel) in the first direction.

When the endless belt moves in the width direction, an end surface of the endless belt contacts the pulley (or wheel) so that the pulley (or wheel) moves outward in the first direction (e.g. away from the endless belt). Accordingly, the curved surface of the link mechanism is pressed by the pulley (or wheel) and the link mechanism is displaced to follow the shape of the curved surface so that one end portion of the steering roller is moved inward in the third direction (e.g. away from the endless belt, so as to reduce a tension of the endless belt) to tilt the steering roller. The tension of the endless belt at one end portion (e.g. first end portion) of the steering roller becomes weak as compared with the other end portion (e.g. second end portion). As a result, since the endless belt moves to the other end portion in the width direction, the misalignment of the endless belt is corrected.

Accordingly, an example image forming system, with reference to FIGS. 1 to 4(*c*), may comprise a drive roller 2, a suspension roller 3, a steering roller 6, a wheel (or pulley) 7, and a link mechanism 8. The drive roller 2 is configured to drive an endless belt 4 to rotate along an operational path. The suspension roller 3 is configured to rotatably support the endless belt 4. The steering roller 6 is located between the drive roller 2 and the suspension roller 3 to engage the endless belt 4, and the steering roller 6 is tiltable to vary a tension of the endless belt 4. The wheel (or pulley) 7 is located at an end portion 6*b* of the steering roller 6 to engage an edge portion (or "end portion") 4*c* of the endless belt 4. The wheel 7 is movable along the end portion 6*b* of the steering roller 6 in response to a shifting of the endless belt 4 away from the operational path. The link mechanism 8 comprises a swing head (or pressing portion) 16 coupled to the end portion 6*b* of the steering roller 6 adjacent the wheel 7. The swing head 16 is pivotally mounted to a pivot base (or support point portion) 14, to rotate when the wheel 7 is biased against the swing head 16. A rotation of the swing head 16 moves the end portion 6*b* of the steering roller 6 away from the endless belt 4, causing the tension at the edge portion 4*c* of the endless belt 4 to be weakened, as compared to a tension of the endless belt 4 at an opposite edge portion of the endless belt 4. The weaker tension at the edge portion 4*c*, biases the endless belt 4 to shift back toward the operational path. The image forming system may comprise an image forming apparatus such as a printer or the like (e.g. color image forming apparatus 61, see FIG. 8), or a portion thereof, such as a belt driving device, for example.

The steering roller may be disposed between the drive roller and the suspension roller to be located on the side of the drive roller in relation to an intermediate point. Also in such a configuration, it is possible to increase a movement speed in the width direction of the endless belt at the time of tilting the steering roller. As a result, it is possible to promptly correct the misalignment of the endless belt. Further, the pulley (or wheel) may be provided at each of both end portions of the steering roller. The link mechanism may be provided at each of both sides in the first direction. When the pulley (or wheel) and the link mechanism are disposed in this way, the endless belt contacts the pulley (or wheel) even when the endless belt moves in any direction of the first direction. Accordingly, it is possible to correct the misalignment by tilting the steering roller and moving the endless belt in the width direction.

A maximum movement amount of the end portion of the steering roller in the third direction may be equal to or larger than a maximum strain amount of the belt driving device. Accordingly, it is possible to correct the misalignment of the endless belt in the width direction even when the belt driving device is distorted and the endless belt is displaced while the belt driving device is installed.

The pulley (or wheel) may be provided only at one end portion of the steering roller. The link mechanism may be provided only at one end portion of the steering roller to correspond to the pulley (or wheel). Accordingly, it is possible to decrease the number of components and to have a simple configuration as compared with a case in which the pulley (or wheel) and the link mechanism are provided at both sides. Further, it is possible to suppress an increase in size of the belt driving device in the first direction.

In a state in which the pulley (or wheel) is not pressed by the endless belt, a contact position between the steering roller and the endless belt may be deviated outward by a maximum strain amount or more of the belt driving device from a position of the endless belt when the steering roller does not exist (e.g. does not project) in the third direction. Also in such a configuration, it is possible to generate a tension suitable for the endless belt and to increase the friction between the endless belt and the steering roller.

The belt driving device may further include a lap amount adjustment mechanism which is disposed on an upstream side or a downstream side of the steering roller in a circumferential movement direction of the endless belt and presses the endless belt against the steering roller to increase a contact area between the endless belt and the steering roller. The lap amount may refer to, for example, a contact length between the outer circumferential surface of the steering roller and the inner circumferential surface of the endless belt in the circumferential direction of the steering roller. Accordingly, it is possible to reliably move the endless belt in the width direction in response to the inclination of the steering roller by increasing the lap amount. The lap amount adjustment mechanism may press the end portion of the endless belt in the width direction against the steering roller.

A contact length between the steering roller and the endless belt in the circumferential direction of the steering roller may be ¼ or more of the circumference of the steering roller. Accordingly, it is possible to increase the friction between the endless belt and the steering roller and to increase the tension applied to the endless belt.

The link mechanism may include a swing member that is swingable about an axis fine extending in the second direction and presses the end portion of the steering roller inward in the third direction. The swing member may include a support point portion which is disposed inside the steering roller in the third direction and is rotatably supported by a base portion. The swing member may include a continuous portion which is connected to the support point portion, bypasses the steering roller, and extends from an inside to an outside of the steering roller in the third direction. The link mechanism may include a pressing portion which is connected to the continuous portion and presses the steering roller from the outside in the third direction.

The belt driving device may further include a spring member that urges a bearing member rotatably supporting the steering roller outward in the third direction.

The endless belt may be a transfer belt for transferring a toner image. The transfer belt can be formed by a resin or elastic body. The end portion of the transfer belt in the width direction may be disposed outside an image forming area in the first direction and may be formed to be harder or thicker than the image forming area.

The end portion of the endless belt in the width direction may be subjected to a high hardness treatment. The end portion of the endless belt in the width direction may be subjected to a high hardness coating treatment as the high hardness treatment. A reinforcement member may be disposed at the end portion of the endless belt in the width direction.

According to example belt driving devices, example image forming apparatuses and example image forming systems, it is possible to correct a misalignment by reliably detecting a movement of an endless belt in a width direction even in an endless belt without ribs. Accordingly, it is possible to improve the operation of the belt driving device and/or of the image forming apparatus/system, as well as the quality of the generated image.

Figure 2:
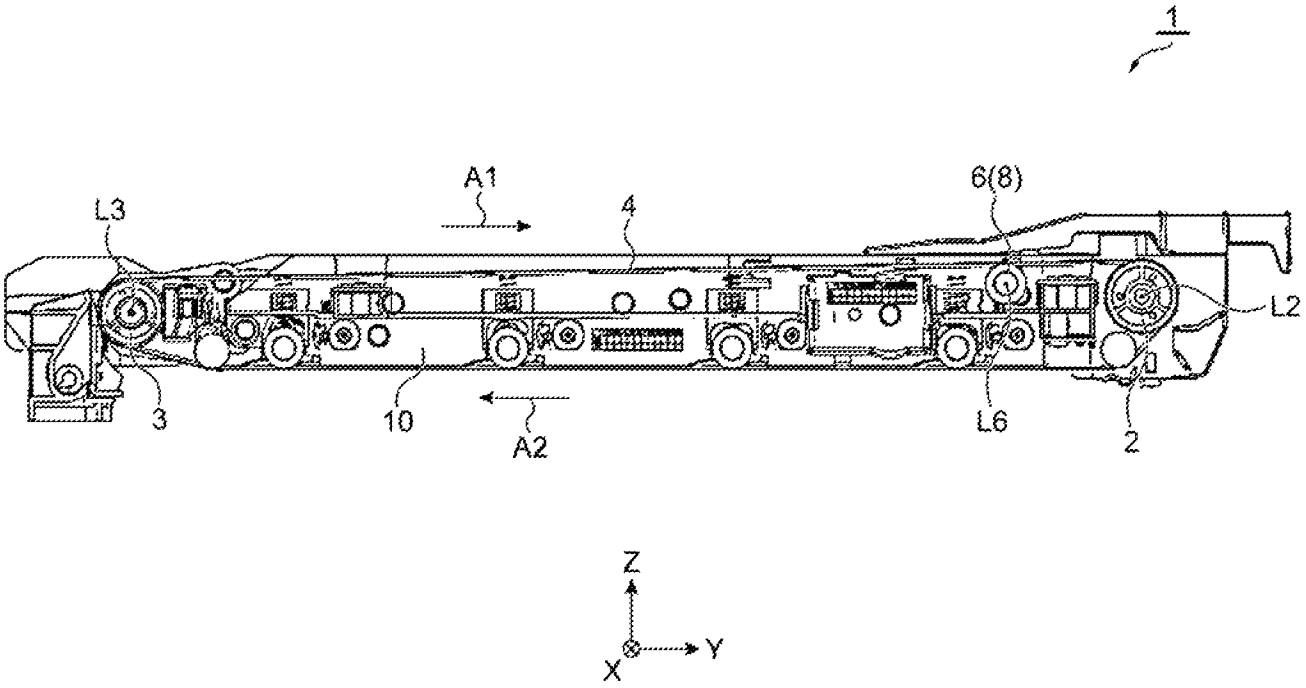
FIG. 2 is a side view of the belt driving device illustrated in FIG. 1.

An example belt driving device 1 illustrated in FIGS. 1 and 2 includes a drive roller 2, a suspension roller 3, and an endless belt 4. The drive roller 2 and the suspension roller 3 extend in an X direction (first direction) and are disposed to face each other in a Y direction (second direction) intersecting the X direction. Additionally, a direction intersecting the X direction and the Y direction will be referred to as a Z direction (third direction).

Power is transmitted from an electric motor (not illustrated) to the drive roller 2 so that the drive roller rotates about an axis line L2 extending in the X direction.

The endless belt 4 is wound on the drive roller 2 and the suspension roller 3 and moves along a circumferential orbit with the rotation of the drive roller 2. The suspension roller 3 rotates about an axis line L3 with the movement of the endless belt 4.

A bearing (not illustrated) which supports the drive roller 2 is supported by frames 10 provided at both sides in the X direction and extending in the Y direction. Similarly, a bearing (not illustrated) which supports the suspension roller 3 is supported by the frames 10 provided at both sides in the X direction and extending in the Y direction. Further, the inner circumferential side of the endless belt 4 is not provided with any ribs which are convex portions for restricting the movement of the endless belt 4 in the width direction.

The belt driving device 1 is used as a transfer unit which secondarily transfers a toner image developed by a developing unit to a sheet, for example, in an image forming apparatus such as a printer. The endless belt 4 also serves as an intermediate transfer belt in the transfer unit. Further, the belt driving device 1 can be used as a sheet conveying unit which conveys a sheet. The endless belt 4 serves as a sheet conveyor belt in the sheet conveying unit.

The belt driving device 1 includes a belt position correction unit 5 which corrects the movement of the endless belt 4 in the width direction (the X direction). The belt position correction unit 5 includes a steering roller 6, a pulley (or wheel) 7, and a link mechanism 8.

The steering roller 6 is disposed between the drive roller 2 and the suspension roller 3 in the Y direction. The steering roller 6 is disposed on the upstream side of the drive roller 2 and the downstream side of the suspension roller 3 in a circumferential movement direction A1 of the endless belt 4, The steering roper 6 is disposed at the upper side of the circumferential orbit of the endless belt 4 to come into contact with an inner circumferential surface 4*a* (see FIG. 3) of the endless belt 4 moving from the suspension roller 3 toward the drive roller 2. The steering roller 6 is disposed on the side of the drive roller 2 in relation to an intermediate point between the drive roller 2 and the suspension roller 3 in the Y direction and is disposed near the drive roller 2 in relation to the suspension roller 3.

Figure 3:
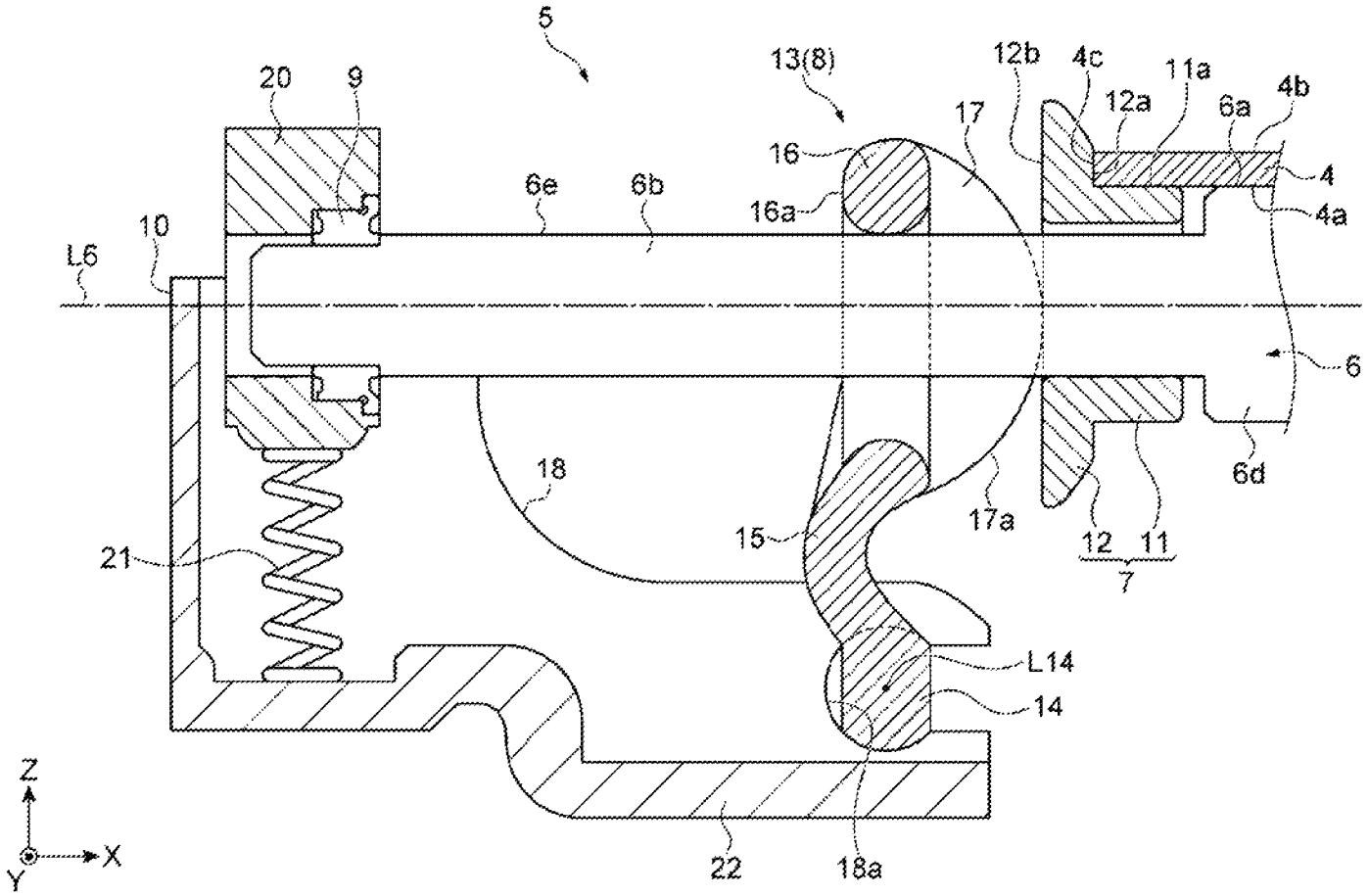
FIG. 3 is a cross-sectional view illustrating a belt position correction unit of the example belt driving device of FIG. 1.
Figure 4:
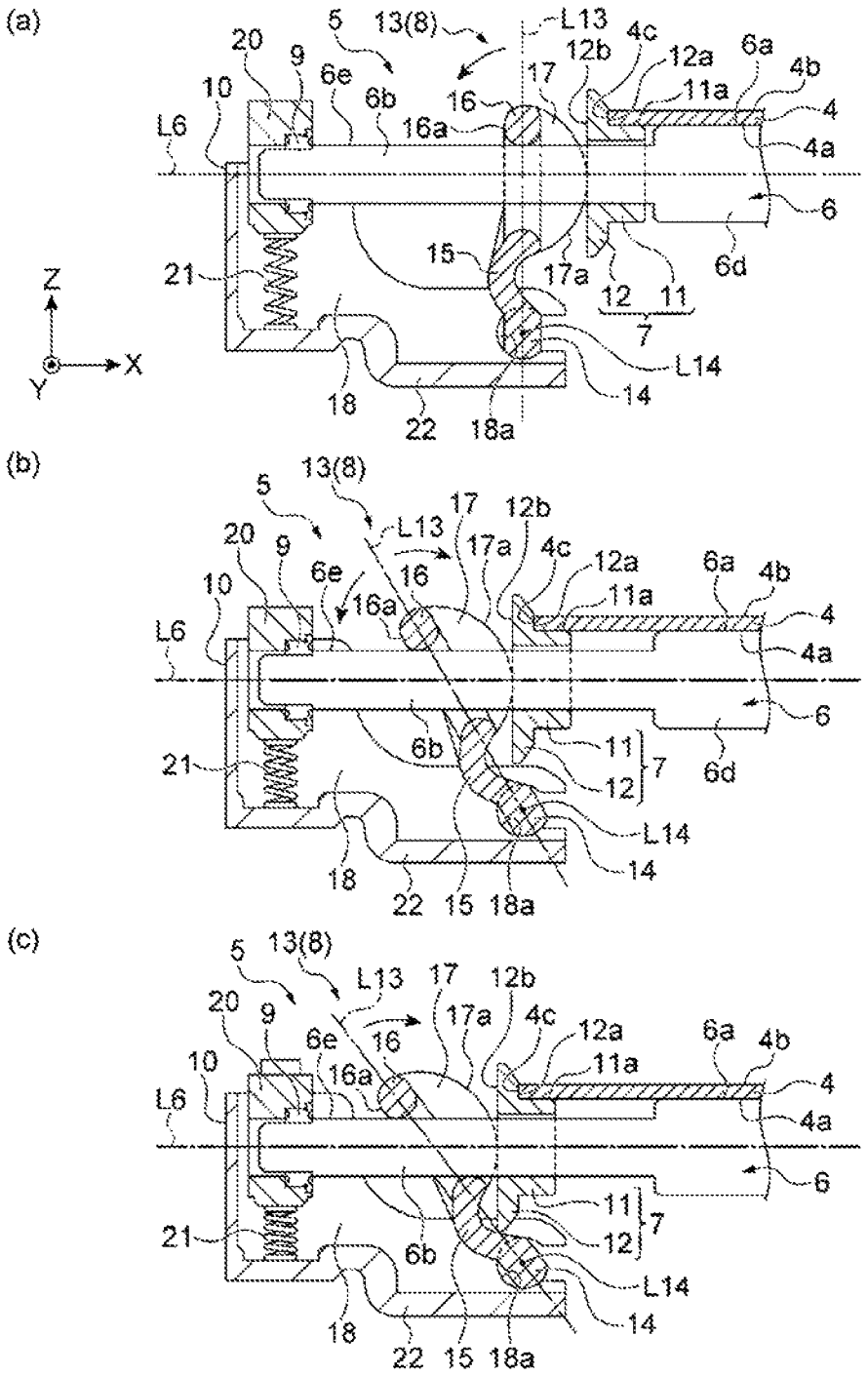
FIGS. 4(*a*)-(*c*) are cross-sectional views illustrating a change of the belt position correction unit illustrated in FIG. 3.

As illustrated in FIGS. 3 and 4(*a*)-(*c*), an outer circumferential surface 6*a* of the steering roller 6 comes into contact with the inner circumferential surface 4*a* of the endless belt 4. The steering roller 6 rotates in a following manner about an axis line L6 with the circumferential movement of the endless belt 4. Both end portions (a first end portion 6*b* and a second end portion 6*c*, see FIG. 1) of the steering roller 6 are rotatably supported by a bearing (bearing member) 9. The bearing 9 is supported by the frames 10 disposed at both sides of the endless belt 4 in the width direction. The first end portion 6*b* of the steering roller 6 is displaceable in the Z direction (third direction). The steering roller 6 is tiltable about the second end portion 6*c* as a support point while the first end portion 6*b* is pressed. In the belt position correction unit 5, the pulley (or wheel) 7 and the link mechanism 8 are provided only at the first end portion 6*b* of the steering roller 6.

The pulley (or wheel) 7 is inserted through the first end portion 6*b* of the steering roller 6, The pulley (or wheel) 7 includes a cylindrical portion 11 and a flange portion 12. The pulley (or wheel) 7 is slidable in the extension direction of the steering roller 6. An outer diameter of the first end portion 6*b* of the steering roller 6 is smaller than an outer diameter of a main body portion 6*d* of the steering roller 6. A length of the main body portion 6*d* of the steering roller 6 in the X direction is slightly shorter than the width of the endless belt 4 (the length in the X direction). An outer diameter of the cylindrical portion 11 is substantially the same as the outer diameter of the main body portion 6*d* of the steering roller 6. An outer circumferential surface 11*a* of the cylindrical portion 11 and the outer circumferential surface 6*a* of the main body portion 6*d* of the steering roller 6 are located at substantially the same position away from the axis line L6 in the radial direction of the steering roller 6. The outer circumferential surface 11*a* of the cylindrical portion 11 is able to come into contact with the inner circumferential surface 4*a* of the endless belt 4.

The flange portion 12 is formed in a disc shape and protrudes outward in relation to the outer circumferential surface 11*a* of the cylindrical portion 11 in the radial direction. The flange portion 12 protrudes outward in relation to the outer circumferential surface 4*b* of the endless belt 4 in the radial direction. An inner surface 12*a* of the flange portion 12 faces the end portion 4*c* of the endless belt 4 in the X direction so as to be able to come into contact therewith. An end portion the endless belt in this example, includes the end portion 4*c*. The end portion is also referred to herein as an edge portion. The inner surface 12*a* of the flange portion 12 is a surface facing inward in the extension direction of the axis line L6 of the steering roller 6 and is a surface on the side of the endless belt 4. An outer surface 12*b* of the flange portion 12 is a surface facing outward in the extension direction of the axis line L6 and is a surface on the side of the bearing 9.

The link mechanism 8 includes a swing member 13 that is swingable about an axis line L14 extending in the Y direction. The swing member 13 includes a support point portion 14, a continuous portion (or arm) 15, a pressing portion (or swing head) 16, and a curved portion 17. The support point portion (pivot base) 14 is formed in a columnar shape and is rotatably supported by a connection tool (base portion) 18 fixed to the frame 10. The support point portion 14 is fitted to an accommodation portion 18*a* provided in the connection tool 18 and is rotatable about the axis line L14. The support point portion 14 is disposed at the inside of the endless belt 4 in the Z direction and is disposed below the steering roller 6 along line L13. Further, the support point portion 14 is disposed at a position corresponding to the first end portion 6*b* of the steering roller 6 in the X direction.

The continuous portion 15 is connected to the support point portion 14 and extends to the steering roller 6. The continuous portion 15 bypasses the steering roller 6 and extends from the inside to the outside of the steering roller 6 in the Z direction. The continuous portion 15 is disposed to intersect the steering roller 6 as viewed from the Y direction.

The pressing portion 16 is connected to the opposite side to the support point portion 14 in the continuous portion 15. The pressing portion 16 is formed in, for example, a columnar shape and extends in the Y direction. The pressing portion 16 is disposed above the steering roller 6 in the Z direction. Further, the pressing portion 16 is disposed outside the pulley (or wheel) 7 in the X direction. An outer circumferential surface 16*a* of the pressing portion 16 comes into contact with an outer circumferential surface Se of the first end portion 6*b* of the steering roller 6. Specifically, a lower portion of the outer circumferential surface 16*a* of the pressing portion 16 comes into contact with an upper portion of the outer circumferential surface 6*e* of the first end portion 6*b*.

The curved portion 17 protrudes inward in the X direction (toward the pulley (or wheel) 7) from the upper portion of the continuous portion 15. The curved portion 17 is provided at a position overlapping the steering roller 6 in the Z direction. The curved portion 17 includes a curved surface 17*a* which protrudes toward the pulley (or wheel) 7. The curved surface 17*a* is curved in a semi-circular shape as viewed from the Y direction. The curved surface 17*a* comes into contact with the outer surface 12*b* of the flange portion 12 of the pulley (or wheel) 7 in the X direction.

A bearing accommodation portion 20 which accommodates the bearing 9 is supported on the frame 10 by a spring member 21. The spring member 21 is, for example, a compressed coil spring, extends in the Z direction, and supports the bearing accommodation portion 20 from below. A lower end portion of the spring member 21 is fixed to an overhanging portion 22 which protrudes from the frame 10 inward in the X direction. An upper end portion of the spring member 21 is connected to the bearing accommodation portion 20. The spring member 21 is lengthened and shortened in the X direction and urges the bearing accommodation portion 20 upward.

The connection tool 18 is fixed to the frame 10 and is disposed to protrude inward in the X direction. The connection tool 18 is connected to the overhanging portion 22. The connection tool 18 is provided with the accommodation portion 18*a* to which the support point portion 14 is fitted. The accommodation portion 18*a* includes a curved surface (sliding surface) which comes into contact with the support point portion 14.

Figure 5:
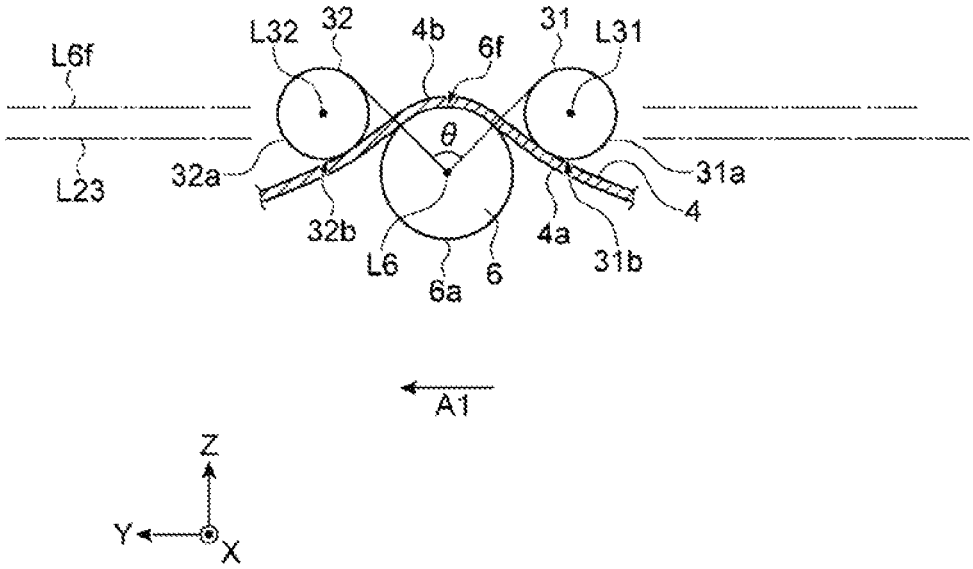
FIG. 5 is a diagram illustrating the arrangement of a lap amount adjustment roller in a lap adjustment mechanism of the example belt driving device of FIG. 1.

Further, the belt driving device 1 includes, as illustrated in FIGS. 1 and 5, lap amount adjustment rollers (lap amount adjustment mechanisms) 31 and 32 which are disposed on the upstream side and the downstream side of the steering roller 6 in the circumferential movement direction A1 of the endless belt 4. The lap amount may refer to, for example, a contact length between the outer circumferential surface 6*a* of the steering roller 6 and the inner circumferential surface 4*a* of the endless belt 4 in the circumferential direction of the steering roller 6. The lap amount adjustment roller 31 is disposed on the upstream side of the steering roller 6 and the lap amount adjustment roller 32 is disposed on the downstream side of the steering roller 6. As illustrated in FIG. 5, bottom points 31*b* and 32*b* of outer circumferential surfaces 31*a* and 32*a* of the lap amount adjustment rollers 31 and 32 are disposed below top points 6*f* of the outer circumferential surfaces 6*a* of the steering rollers 6.

The lap amount adjustment rollers 31 and 32 are supported by the frame 10 on the side of the first end portion 6*b* of the steering roller 6. The lap amount adjustment rollers 31 and 32 are rotatable about axis lines L31 and L32 extending in the X direction. The lap amount adjustment rollers 31 and 32 come into contact with the outer circumferential surface 4*b* of the endless belt 4 and rotate in a following manner with the circumferential movement of the endless belt 4. The lap amount adjustment rollers 31 and 32 are provided only in the vicinity of the first end portion 6*b* of the steering roller 6 in the X direction as illustrated in FIG. 1. When the endless belt 4 is pressed downward by the lap amount adjustment rollers 31 and 32, a contact area between the steering roller 6 and the endless belt 4 increases.

In the circumferential direction of the steering roller 6, a contact length between the outer circumferential surface 6*a* of the steering roller 6 and the inner circumferential surface 4*a* of the endless belt 4 is ¼ or more of the circumference of the steering roller 6. For example, the outer circumferential surface 6*a* of the steering roller 6 contacts the endless belt 4 by 90° or more in the rotation angle θ of the steering roller 6. In the circumferential direction of the steering roller 6, the contact length between the outer circumferential surface 6*a* of the steering roller 6 and the inner circumferential surface 4*a* of the endless belt 4 may be ⅓ or more of the circumference of the steering roller 6. For example, the outer circumferential surface 6*a* of the steering roller 6 contacts the endless belt 4 by 120° or more in the rotation angle θ of the steering roller 6. Accordingly, it is possible to increase the friction between the endless belt 4 and the steering roller 6 by increasing the lap amount.

Next, an operation of the example belt driving device 1 will be described. Power is transmitted to the endless belt 4 by the drive roller 2 so that the endless belt 4 circumferentially moves. The suspension roller 3 rotates with the movement of the endless belt 4. Further, the steering roller 6 rotates with the movement of the endless belt 4.

Here, when the endless belt 4 is deviated (or shifted) to the outside in the width direction toward the first end portion 6*b*, the end portion 4*c* of the endless belt 4 contacts the inner surface 12*a* of the flange portion 12 of the pulley (or wheel) 7. When the movement amount of the endless belt 4 in the width direction increases, the endless belt 4 presses the pulley (or wheel) 7. As illustrated in FIGS. 4(*b*) and 4(*c*), when the pulley (or wheel) 7 moves outward, the curved portion 17 of the swing member 13 is pressed by the pulley (or wheel) 7. Accordingly, the swing member 13 swings about the support point portion 14 as a support point and moves downward while the pressing portion 16 moves outward in the Y direction. For that reason, the first end portion 6*b* of the steering roper 6 is pressed downward to tilt the steering roller 6. The steering roller 6 swings to be tilted about the second end portion 6*c* opposite to the first end portion 6*b*.

When the steering roller 6 is tilted, the tension of the endless belt 4 at the first end portion 6*b* becomes weak as compared with the second end portion Sc. As a result, the endless belt 4 moves toward the second end portion 6*c* which is a strong tension side in the width direction so that the misalignment of the endless belt 4 is corrected. Then, when the endless belt 4 moves toward the second end portion 6*c*, a force in which the endless belt 4 presses the pulley (or wheel) 7 outward in the X direction becomes weak. Since the spring member 21 urges and presses the bearing accommodation portion 20 upward in accordance with this movement, the bearing 9 and the first end portion 6*b* move upward and the swing member 13 moves upward and inward in the X direction. The swing member 13 and the pulley (or wheel) 7 return to original positions as illustrated in FIG. 4(*a*).

In this way, according to the belt driving device 1, in the configuration including the endless belt 4 without ribs, the end portion 4*c* (end portion) of the endless belt 4 is brought into contact with the pulley (or wheel) 7 and the swing member 13 is driven so that the steering roller 6 is tilted. As a result, it is possible to correct the movement of the endless belt 4 in the width direction.

According to the belt driving device 1, since the misalignment of the endless belt 4 in the width direction is corrected, the meandering of the endless belt 4 can be suppressed. Further, in the belt driving device 1, the deformation (undulation) of the endless belt 4 due to a variation in tension of the endless belt 4 can be suppressed. In the intermediate transfer unit including the belt driving device 1, the uniformity of an image transferred onto the endless belt 4 can be secured.

In the belt driving device 1, the endless belt 4 is not provided with ribs. In the endless belt with ribs, there is concern that the running property of the belt is affected by the shape of the rib. Since a particular tool is necessary in order to design the shape of the rib according to a design with high accuracy, a manufacturing cost increases. Further, when the distortion of the endless belt 4 occurs only at one side, the rib or rib contact member is easily worn and hence the running property may be degraded as time goes by. Further, when a roller corresponding to a cleaning member for cleaning the endless belt 4 is mainly distorted, the blade of the cleaning member may be unevenly worn. Accordingly, a cleaning failure may occur.

In the belt driving device 1, since the endless belt 4 is not provided with ribs, the belt running property can be stabilized. In the belt driving device 1, since the endless belt 4 is not provided with ribs, it is possible to prolong the life of the endless belt 4. In the belt driving device 1, since the endless belt 4 is not provided with ribs, it is possible to suppress an increase in manufacturing cost. In the belt driving device 1, since the endless belt 4 is not provided with ribs, it is possible to prevent a cleaning failure.

Figure 6:
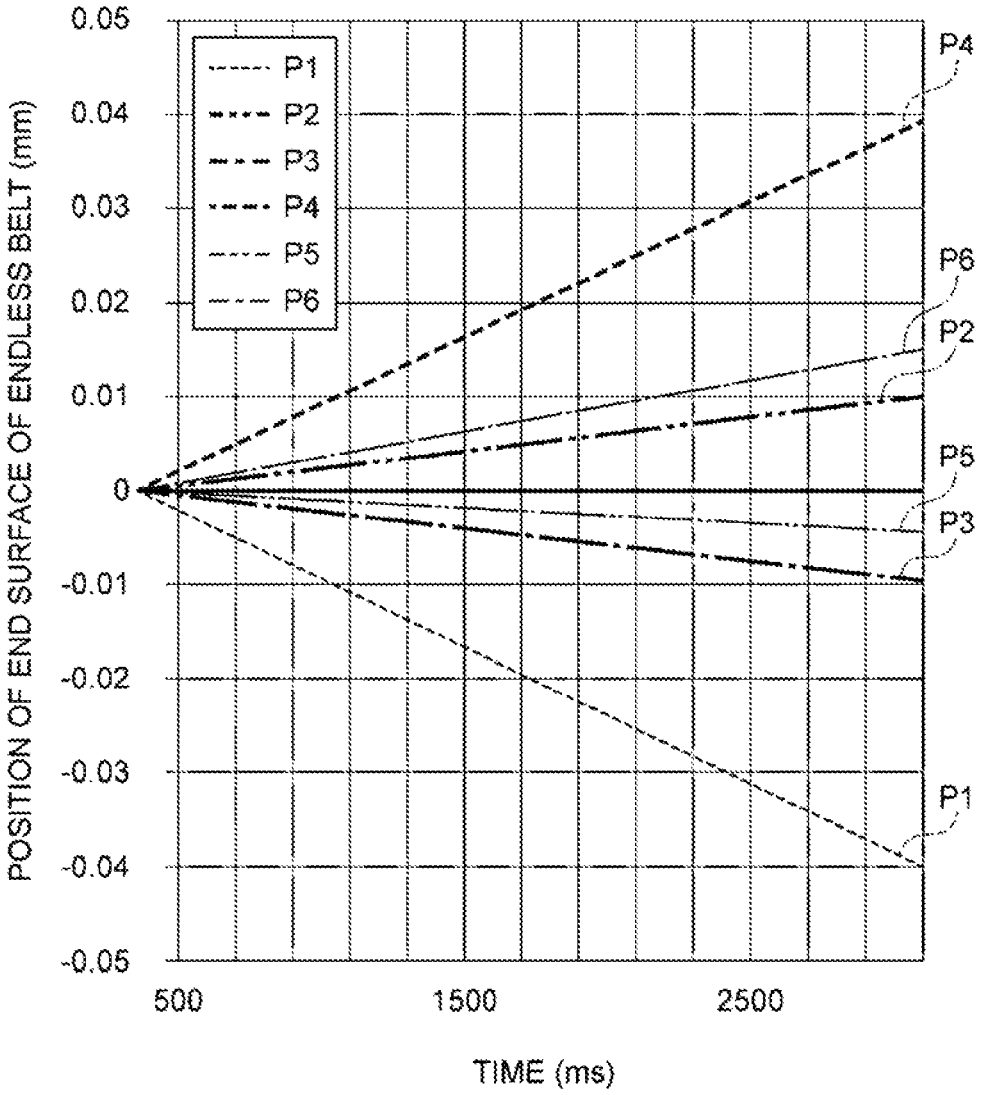
FIG. 6 is a graph showing a relationship between a position of a steering roller and a misalignment correction sensitivity of an endless belt.

Next, a relationship between the arrangement position of the steering roller 6 and the movement speed of the endless belt 4 in the width direction will be described with reference to FIG. 6. In FIG. 6, a horizontal axis indicates a time [ms] and a vertical axis indicates the position of the end portion 4*c* of the endless belt 4. The position of the end surface 4*c* is the position of the endless belt 4 in the width direction and the position in the extension direction of the axis line L6. At this time, the inclination angle of the steering roller 6 is the same.

Figure 7:
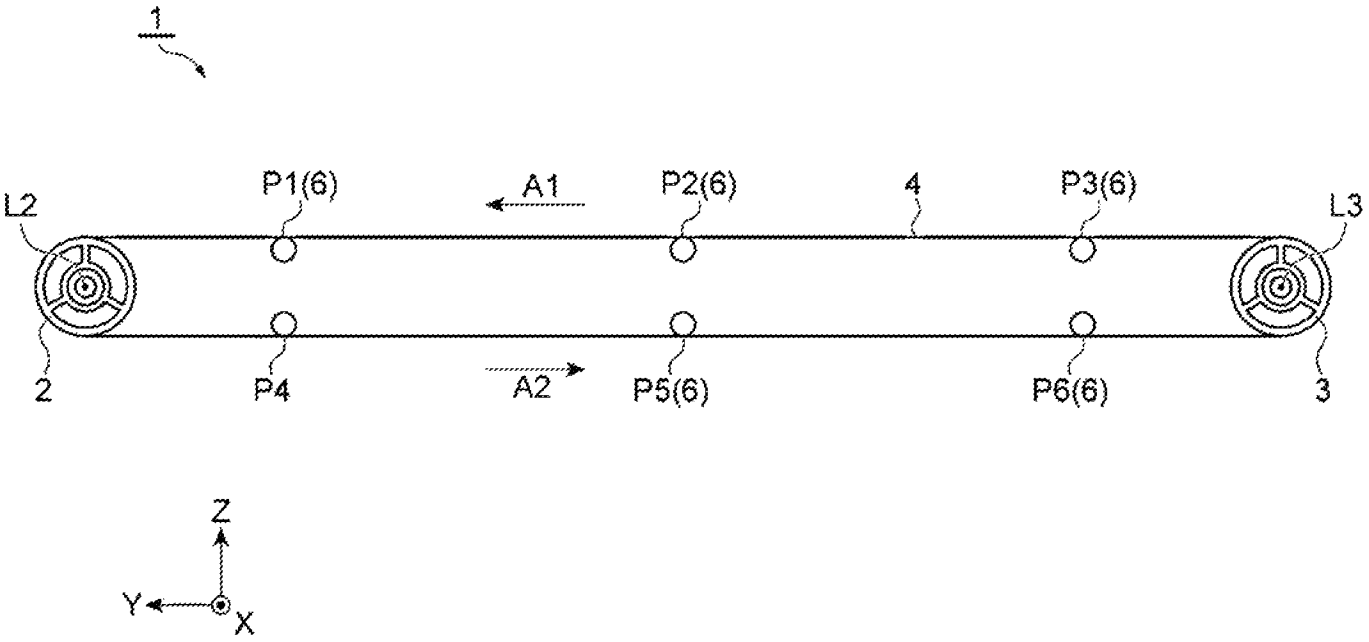
FIG. 7 is a side view illustrating an example arrangement of an endless belt, a drive roller, a suspension roller, and a steering roller.

As illustrated in FIG. 7, a change in position of the endless belt 4 in the width direction is measured while the arrangement positions P1 to P6 of the steering roller 6 are changed. The arrangement positions P1 to P3 are located on the upstream side of the drive roller 2 and the downstream side of the suspension roller 3. At the arrangement positions P1 to P3, the endless belt 4 moves along the circumferential movement direction A1 from the suspension roller 3 toward the drive roller 2 (tension side). The arrangement positions P4 to P6 are located on the downstream side of the drive roller 2 and the upstream side of the suspension roller 3. At the arrangement positions P4 to P6, the endless belt 4 moves along a circumferential movement direction A2 from the drive roller 2 toward the suspension roller 3 (loose side). Further, the arrangement positions P1 and P4 are located in the vicinity of the drive roller 2 and the arrangement positions P3 and P6 are located in the vicinity of the suspension roller 3. The arrangement positions P2 and P5 are intermediate positions between the drive roller 2 and the suspension roller 3 in the Y direction.

As shown in FIG. 6, as the inclination of the line of the graph increases, the movement amount of the endless belt 4 in the width direction increases and the correction sensitivity (response performance) increases. That is, it is effective that the misalignment of the endless belt 4 in the width direction can be corrected with improved efficiency as the inclination of the graph increases. Since the inclination of the graph (P1, P4) is large as the steering roller 6 is close to the drive roller 2, the misalignment of the endless belt 4 in the width direction can be corrected with improved efficiency.

In another example belt driving device 1, the first end portion 6*b* of the steering roller 6 applies a strain equal to or larger than the maximum strain amount of the belt driving device 1 to the endless belt 4 in a condition in which the belt driving device 1 is installed in the initial state. The initial state may indicate a state in which the pulley (or wheel) 7 is not pressed by the end portion 4*c* of the endless belt 4 and the misalignment of the endless belt 4 in the width direction does not occur as illustrated in FIG. 3.

In the belt driving device 1, a contact position L6*f* between the steering roller 6 and the endless belt 4 is deviated to the outside by a maximum strain amount or more of the belt driving device 1 from a position L23 of the endless belt 4 when the steering roller 6 does not exist (e.g. does not project) in the Z direction as illustrated in FIG. 5 in the initial state. The contact position L6*f* between the steering roller 6 and the endless belt 4 may refer to the highest position in an area in which the steering roller 6 contacts the endless belt 4 and is, for example, a top point 6*f* of the outer circumferential surface 6*a* of the steering roller 6. Further, the position L23 of the endless belt 4 when the steering roller 6 does not exist (or does not project) may be, for example, the position of the tangent line which is in contact with the upper portion of the outer circumferential surface of the drive roller 2 and the upper portion of the outer circumferential surface of the suspension roller 3. Further, the maximum strain amount or more of the belt driving device 1 is, for example, the maximum strain amount or more when the belt driving device 1 is installed in a use environment and can be set to be equal to or larger than a difference in height between both end portions of the drive roller 2. For example, the first end portion 6*b* of the steering roller 6 is disposed at a slightly high position compared to the second end portion 6*c* in the initial state. Further, the maximum movement amount of the end portion of the steering roller 6 in the Z direction may be equal to or larger than the maximum strain amount of the belt driving device 1.

In the belt driving device 1 of the present example, since the tension of the first end portion 6*b* of the steering roller 6 with respect to the endless belt 4 is high as compared with the second end portion 6*c* in the initial state, the endless belt 4 is easily deviated to the first end portion 6*b* rather than the second end portion 6*c* and is not easily deviated to the second end portion Sc. For that reason, when the endless belt 4 moves to the first end portion 6*b*, the swing member 13 is made to swing to press the first end portion 6*b* downward so that the inclination of the steering roller 6 is changed and the endless belt 4 can be returned to the second end portion 6*c*. Accordingly, the misalignment of the endless belt 4 in the width direction can be corrected.

According to another example of the belt driving device 1, the pulley (or wheel) 7 and the link mechanism 8 may be provided at both end portions of the steering roller 6. Similarly to the first end portion 6*b*, the second end portion 6*c* of the steering roller 6 is provided with the pulley (or wheel) 7, the link mechanism 8, the connection tool 18, the spring member 21, and the lap amount adjustment roller 31.

Accordingly, the endless belt 4 may be deviated in either direction, to contact the pulleys (or wheels) 7 disposed at both sides, power is transmitted by the link mechanism 8, and the first end portion 6*b* or the second end portion 6*c* of the steering roller 6 is pressed downward so that the steering roller 6 can be tilted. Accordingly, it is possible to correct the misalignment by returning the endless belt 4 to the opposite side.

Figure 8:
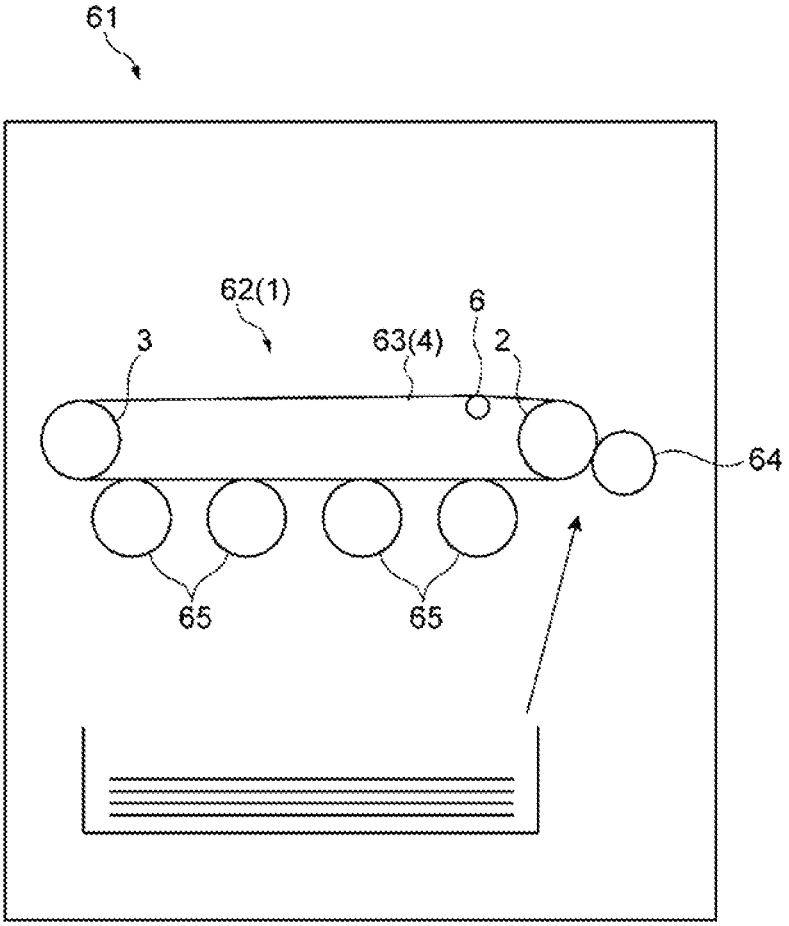
FIG. 8 is a schematic diagram illustrating an example color image forming apparatus including an intermediate transfer unit.

Another example color image forming apparatus 61 including an intermediate transfer unit will be described, with reference to FIG. 8. The color image forming apparatus 61 includes the belt driving device 1 as an intermediate transfer unit 62, The intermediate transfer unit 62 includes the drive roller 2, the suspension roller 3, an intermediate transfer belt 63 which is the endless belt 4, and a secondary transfer roller 64. The secondary transfer roller 64 is disposed to press a sheet which is a recording medium against the intermediate transfer belt 63 moving along the drive roller 2. The color image forming apparatus 61 includes a photosensitive body 65 and further includes various suitable configurations necessary as the image forming apparatus.

The photosensitive body 65 is disposed at a plurality of positions along the movement direction of the intermediate transfer belt 63.

A toner image formed on the photosensitive body 65 is primarily transferred to the intermediate transfer belt 63. The primarily transferred toner image is secondarily transferred to the sheet pressed by the secondary transfer roller 64. The toner image which is secondarily transferred to the sheet is fixed by a fixing device (not illustrated). Further, the intermediate transfer unit 62 is provided with a cleaning blade (not illustrated) which removes the residual toner adhering to the intermediate transfer belt 63. The cleaning blade is pressed against the intermediate transfer belt 63 to remove the residual toner.

Since such a color image forming apparatus 61 also includes the belt driving device 1, it is possible to prevent the misalignment of the intermediate transfer belt 63 in the width direction. In the intermediate transfer unit 62, a deformation such as undulation of the intermediate transfer belt 63 is prevented. For that reason, it is possible to prevent a decrease in adhesion between the cleaning blade and the intermediate transfer belt 63, to appropriately remove the residual toner, and to improve the image quality.

Figure 9:
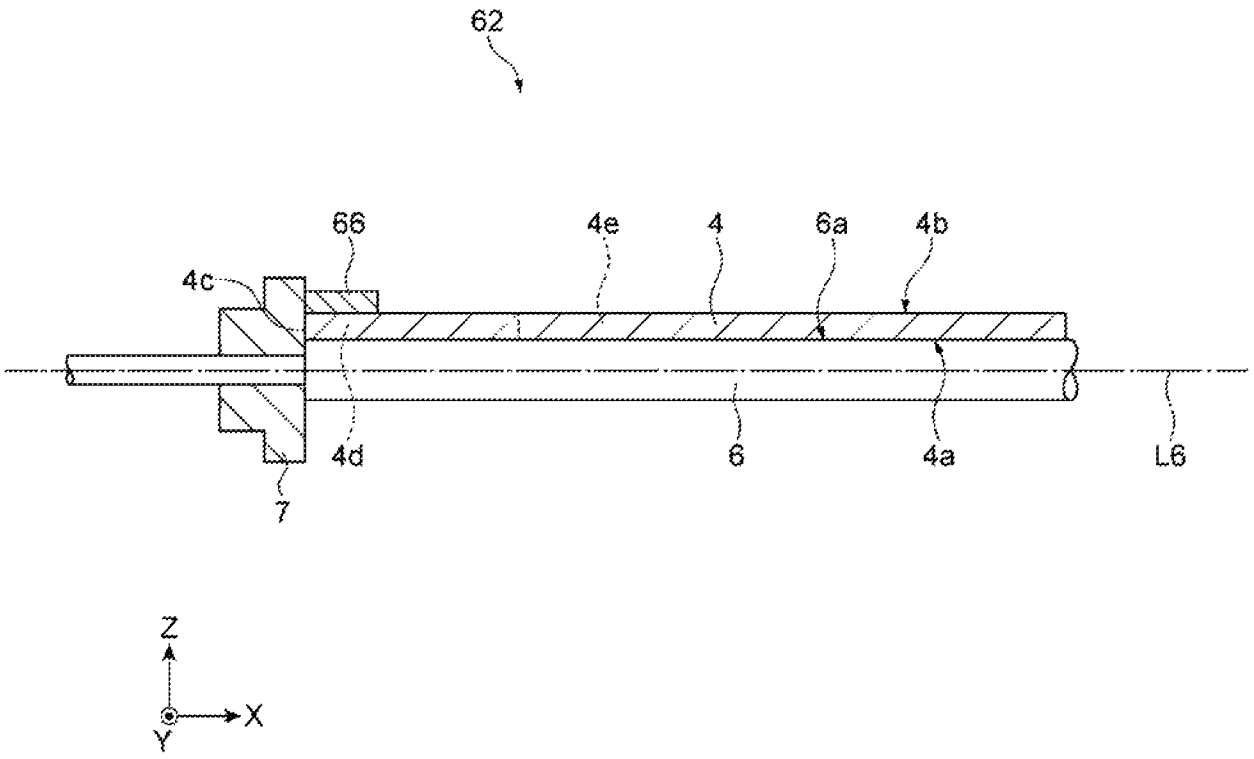
FIG. 9 is a cross-sectional view illustrating the steering roller, a pulley (or wheel), and the endless belt.

Another example intermediate transfer unit will be described, with reference to FIG. 9. The endless belt 4 of the intermediate transfer unit 62 illustrated in FIG. 9 is an intermediate transfer belt to which a toner image is transferred. The endless belt 4 is formed by a resin or elastic body. As the resin which can be applied to the endless belt 4, for example, polyimide, polyamide imide, polyether ether ketone, polyvinylidene difluoride (PVDF), and the like can be exemplified. Further, the surfaces of these resins may be coated with, for example, acrylic or polyurethane. Further, as the elastic body which can be applied to the endless belt 4, for example, rubber type materials such as chloroprene rubber (CR) and nitrile rubber (NBR) can be exemplified.

Further, the end portion 4*d* of the endless belt 4 in the width direction is disposed outside an image forming area 4*e* in the X direction. The image forming area 4*e* is an area to which the toner image is transferred. A portion corresponding to the end portion 4*d* of the endless belt 4 is thicker than the image forming area 4*e*. Since a reinforcement member 66 is provided at the end portion 4*d* of the endless belt 4, a portion corresponding to the end portion 4*d* of the endless belt 4 is thicker than a portion corresponding to the image forming area 4*e*. The reinforcement member 66 adheres to, for example, the endless belt 4. The reinforcement member 66 may be formed of the same material as that of the endless belt 4 or may be formed of a different material. As the reinforcement member 66, for example, a polyethylene terephthalate (PET) resin, a metal tape, or the like can be used.

The reinforcement member 66 may be disposed only on the outer circumferential surface 4*b* (the front surface) of the endless belt 4, may be disposed only on the inner circumferential surface 4*a* (the rear surface), or may be disposed to cover the end portion 4*c*. The end portion 4*d* may be thickened without forming the reinforcement member 66. Further, the outer circumferential surface of the pulley (or wheel) 7 is disposed at the outside in the radial direction in relation to the surface of the reinforcement member 66 while the endless belt 4 is wound on the steering roller 6. The pulley (or wheel) 7 is able to come into contact with the end surface 4*c* of the endless belt 4 and the reinforcement member 66.

In the intermediate transfer unit including such an endless belt 4, since the strength of the end portion 4*d* of the endless belt 4 is increased, the end portion 4*c* can be protected. Damage of the end surface 4*c* due to the contact with the pulley (or wheel) 7 can be suppressed. Accordingly, it is possible to extend the lifetime of the endless belt 4 and to improve the reliability of the intermediate transfer unit 62.

Further, the end portion 4*d* of the endless belt 4 in the width direction may be formed to be harder than the image forming area 4*e*. As the high hardness treatment, for example, an ultraviolet (UV) curing treatment and a heat curing treatment can be performed. The end portion 4*d* can be cured by irradiating UV rays to the end portion 4*d* to cure the resin. Further, the end portion 4*d* can be cured by heating the resin. Further, a high hardness coating treatment may be performed as the high hardness treatment. As the high hardness coating treatment, for example, silicone resin, glass, or the like may be applied to the surface of the endless belt 4.

It is to be understood that not all aspects, advantages and features described herein may necessarily be achieved by, or included in, any one particular example. Indeed, having described and illustrated various examples herein, it should be apparent that other examples may be modified in arrangement and detail.

In the above-described examples, the steering roller 6 is located on the side of the drive roller 2 in relation to the intermediate point between the drive roller 2 and the suspension roller 3 in the Y direction, but the steering roller 6 may be located at the intermediate point or may be disposed at a position near the suspension roller 3. Further, in the above-described examples, the steering roller 6 which is located at the upper side of the circumferential orbit of the endless belt 4 and comes into contact with the endless belt 4 from below has been described, but the steering roller 6 may be located at the lower side of the circumferential orbit of the endless belt 4 and may come into contact with the endless belt 4 from above.

The invention claimed is:

1. A belt driving device comprising:

a drive roller to drive an endless belt;

a suspension roller to rotate in a following manner with a rotational movement of the endless belt when the endless belt is wound on the suspension roller, wherein the drive roller and the suspension roller extend along a first direction and face each other along a second direction intersecting the first direction;

a steering roller located between the drive roller and the suspension roller, the steering roller to rotate in a following manner with the rotational movement of the endless belt, wherein the steering roller extends in a longitudinal direction and comprises an end portion in the longitudinal direction, the end portion being movable along a third direction intersecting the first direction and the second direction, the steering roller to tilt when the end portion moves along the third direction;

a wheel located at the end portion of the steering roller, the wheel protruding in a radial direction of the steering roller, the wheel to contact an edge portion of the endless belt in a width direction of the endless belt, wherein the wheel is movable along a rotational axis of the steering roller when the wheel is pressed via a shifting movement of the endless belt along the first direction to move in an axis line direction of the steering roller; and a link mechanism including a curved surface to contact the wheel in the first direction, the link mechanism to tilt the steering roller by moving the end portion of the steering roller inward in the third direction when the wheel is pressed to move outwardly in the first direction.

2. The belt driving device according to claim 1, wherein the steering roller is located closer to the drive roller than to the suspension roller.

3. The belt driving device according to claim 1, wherein the end portion of the steering roller is a first end portion of the steering roller, and the steering roller further comprises a second end portion opposite the first end portion, wherein the wheel is a first wheel and the link mechanism is a first link mechanism, and wherein the belt driving device further comprises a second wheel and a second link mechanism located at the second end portion of the steering roller.

4. The belt driving device according to claim 1, wherein a maximum movement amount of the end portion of the steering roller in the third direction is equal to or larger than a maximum strain amount of the belt driving device.

5. The belt driving device according to claim 1, wherein the wheel is located only at the end portion of the steering roller, and wherein the link mechanism is located only at the end portion of the steering roller to correspond to the wheel.

6. The belt driving device according to claim 5, wherein in a state in which the wheel is not pressed by the endless belt, a contact position between the steering roller and the endless belt is deviated outwardly by a maximum strain amount or more of the belt driving device from an initial position of the endless belt when the steering roller does not project in the third direction.

7. The belt driving device according to claim 1, further comprising:

a lap amount adjustment mechanism located upstream or downstream of the steering roller in a circumferential movement direction of the endless belt, the lap amount adjustment mechanism to press the endless belt against the steering roller to increase a contact area between the endless belt and the steering roller.

8. The belt driving device according to claim 7, the lap amount adjustment mechanism to press the edge portion of the endless belt in the width direction against the steering roller.

9. The belt driving device according to claim 7, wherein a contact length between the steering roller and the endless belt in a circumferential direction of the steering roller is ¼ or more of a circumference of the steering roller.

10. The belt driving device according to claim 1, wherein the link mechanism includes a swing member that is swingable about an axis line extending in the second direction to press the end portion of the steering roller inward in the third direction, and wherein the swing member includes:

a support point portion located inwardly relative to the steering roller in the third direction and pivotally supported by a base portion, an arm extending from the support point portion, outwardly relative to the steering roller in the third direction, and a pressing portion connected to the arm, to bias the steering roller in the third direction by rotating about the support point portion.

11. The belt driving device according to claim 1, further comprising:

a spring member to urge a bearing member rotatably supporting the steering roller outward in the third direction.

12. The belt driving device according to claim 1, wherein the endless belt is a transfer belt for transferring a toner image.

13. The belt driving device according to claim 12, wherein the transfer belt is formed by a resin or elastic body, and wherein the transfer belt comprises an image forming area and an edge portion located outside an image forming area in the width direction, the edge portion extending in the first direction, the edge portion having a hardness greater than a hardness of the image forming area, or the edge portion having a thickness greater than a thickness of the image forming area.

14. The belt driving device according to claim 1, wherein the edge portion of the endless belt has been subjected to a high hardness treatment.

15. The belt driving device according to claim 14, wherein the edge portion of the endless belt has been subjected to a high hardness coating treatment as the high hardness treatment.

16. The belt driving device according to claim 1, wherein a reinforcement member is disposed at the edge portion of the endless belt.

17. An image forming system comprising:

a drive roller to drive an endless belt to rotate along an operational path;

a suspension roller to rotatably support the endless belt;

a steering roller located between the drive roller and the suspension roller to engage the endless belt, wherein the steering roller is tiltable to vary a tension of the endless belt;

a wheel located at an end portion of the steering roller to engage an edge portion of the endless belt, the wheel being movable along the end portion of the steering roller in response to a shifting of the endless belt away from the operational path; and a link mechanism comprising a swing head coupled to the end portion of the steering roller adjacent the wheel, the swing head being pivotally mounted to a pivot base, to rotate when the wheel is biased against the swing head, wherein a rotation of the swing head moves the end portion of the steering roller away from the endless belt, causing the tension at the edge portion of the endless belt to be weakened, in order to bias the endless belt to shift back toward the operational path.

* * * * *